United States Patent [19]

Rosenberg

[11] 4,281,320

[45] Jul. 28, 1981

[54] COMBINED PROTECTIVE BARRIER AND BURGLAR ALARM

[76] Inventor: Ariel Rosenberg, 4 Ophir St., Tel Aviv, Israel

[21] Appl. No.: 74,421

[22] Filed: Sep. 11, 1979

[51] Int. Cl.[3] ..... G08B 13/08; G08B 13/12

[52] U.S. Cl. ..... 340/545; 340/547; 340/550; 109/41; 200/61.84; 339/74 R

[58] Field of Search ..... 340/545, 550, 548, 547, 340/541, 542; 200/61.84; 109/11, 13, 31, 38, 41; 116/67 R, 86, DIG. 34; 160/10, 166 R, 166 A, 349 R; 339/74 R

[56] References Cited

U.S. PATENT DOCUMENTS

| | | | |
|---|---|---|---|
| 934,108 | 9/1909 | Trautmann | 340/550 |
| 2,293,609 | 8/1942 | Livingston | 200/61.84 |
| 2,724,824 | 11/1955 | Toepfer | 340/548 |
| 3,552,473 | 1/1971 | Persson | 160/166 R |
| 3,668,582 | 6/1972 | Lea | 340/548 |
| 3,676,831 | 7/1972 | Bergwall | 339/74 R |
| 3,696,373 | 10/1972 | Dunn et al. | 340/550 |
| 3,725,891 | 4/1973 | Miller | 340/550 |
| 4,160,972 | 7/1979 | La Mell et al. | 200/61.84 |

*Primary Examiner*—Donald J. Yusko
*Assistant Examiner*—Donnie L. Crosland

[57] ABSTRACT

A protective barrier and burglar alarm in the form of a window blind includes a plurality of slats which may be compacted to open the blind, the slats being supported by flexible cords including electrical conductors establishing an electrically-conductive pathway through the length of the window blind. The lower end of the blind carries retaining means for retaining the blind in its closed position, and circuit-interrupting means effective when the blind is raised or severed to actuate an alarm. In one described embodiment, the retaining means and circuit interrupting means include mating pins and sockets; and in a second described embodiment, they include magnetic retainer elements adapted to actuate a magnetic reed switch carried at the lower end of the blind.

6 Claims, 9 Drawing Figures

COMBINED PROTECTIVE BARRIER AND BURGLAR ALARM

BACKGROUND OF THE INVENTION

The present invention relates to protective barriers for mounting to a structure to cover an opening therein, such as a window or door, and particularly to a combined protective barrier and burglar alarm which is adapted to actuate an alarm or other signalling device in the event of an attempt to make an unauthorized entry.

A number of protective barrier and burglar alarm systems have been proposed, including: mesh-wire screens which actuate an alarm if the screen is cut or shorted (e.g., U.S. Pat. No. 3,696,373) or subjected to a physical force (e.g., U.S. Pat. No. 3,863,242); window blinds having a taut trip element which sets off an alarm if the blind is moved (e.g., U.S. Pat. No. 3,668,582); window grilles defining an electrical capacitance field which is distorted to set off an alarm upon the physical deformation of the grille by an attempted intrusion (e.g., U.S. Pat. No. 3,623,061); roller-blinds which, when raised, actuate an alarm (e.g., U.S. Pat. Nos. 1,392,641, 1,358,636, and 396,701); and various types of other mechanical or magnetic switching arrangements which are actuated to set off an alarm when an unauthorized attempt is made to open the barrier or window (e.g., U.S. Pat. Nos. 4,160,972, 2,293,609, 3,634,845, and 1,003,234). In general, however, the known systems are not entirely satisfactory for one or more of the following reasons: Some systems do not provide for convenient arrangements for opening the barrier and disabling the alarm by an authorized user; others are of complicated and therefore expensive constructions; and most are of unpleasant external appearance.

An object of the present invention is to provide a combined window barrier and burglar alarm system having advantages in the above respects, namely one which presents a pleasing appearance, which can be conveniently opened or disabled by an authorized person, and which is of simple construction and therefore inexpensive to produce.

SUMMARY OF THE INVENTION

According to a broad aspect of the present invention, there is provided a protective barrier for mounting to a structure to cover an opening therein, comprising: a plurality of slats mounted to said structure at one end of said opening and extending in spaced parallel relationship towards the opposite end of said opening; and two groups each including a plurality of flexible cords extending at right angles to said slats along opposite sides thereof, the flexible cords being interwoven between the slats for securing them in said spaced parallel relationship but permitting them to be pivotted to open the slats and to be moved towards said one end of the opening to open the barrier. At least some of said flexible cords including metal wires serving to securely hold the slats together and also to serve as electrical conductors. Each of the groups of flexible cords are of yarn, only some of which include the metal wires in a manner so as not to be readily distinguishable from those yarns which do not include metal wires. Further provided are circuit means including said metal wires establishing an electrically-conductive pathway through the length of said barrier. The protective barrier further includes means for supplying electrical power to said electrically-conductive pathway; an end member secured to the structure along said opposite end of the opening therein; mating retaining means carried by said end member and one end of the barrier mechanically retaining the barrier in its closed position covering said opening; circuit interrupting means effective, when the barrier is retained in its closed position, to establish electrical continuity in said electrically-conductive pathway through the length of said barrier, and when moved from the closed to interrupt said electrical continuity; and a signalling device actuated by an interruption in said pathway caused by the severance of said metal wires in the barrier or by the actuation of said circuit interrupting means.

Two embodiments of the invention are described below for purposes of example. In these embodiments, the barrier is to be mounted with the slats extending horizontally and compactable vertically to permit opening the barrier by raising same.

In one described embodiment, the retaining means and the circuit-interrupting means comprise pins carried at the lower end of the blind receivable within sockets carried by the frame. In a second described embodiment, these means comprise magnetic retainer elements carried by the lower end of the barrier and by the end member, and a reed switch carried by the lower end of the barrier and adapted to actuated by the magnetic element carried by the end member.

Both of the described embodiments are for application to a window, but it will be appreciated they could also be applied to a door or the like.

Further features and advantages of the invention will be apparent from the description below

BRIEF DESCRIPTION OF THE DRAWINGS

The invention is herein described, by way of example only, with reference to the accompanying drawings, wherein.

DESCRIPTION OF PREFERRED EMBODIMENTS

Figure 5:
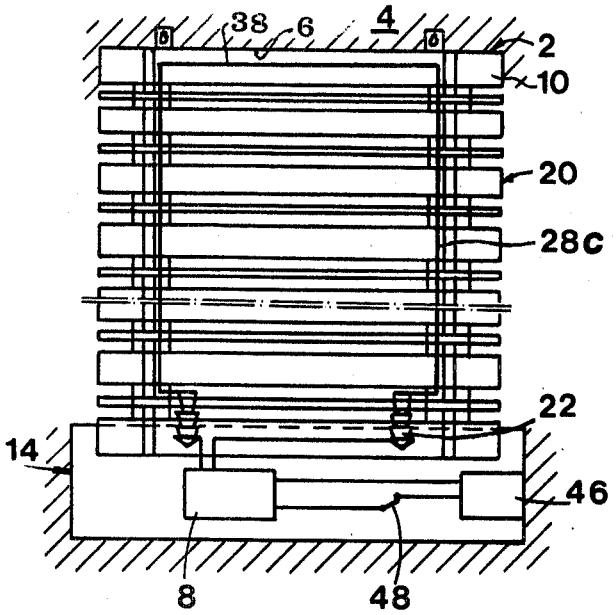
FIG. 5 schematically illustrates the electrical system in the device of FIG. 1.

With reference first to the schematic diagram of FIG. 5, there is shown a combined window barrier and burgler alarm system, generally designated 2, mounted to a wall 4 to cover a window opening 6. The system automatically actuates an alarm 8 in the event an attempt is made to penetrate window 6 by either cutting through the barrier or opening it by an unauthorized person.

Figure 1:
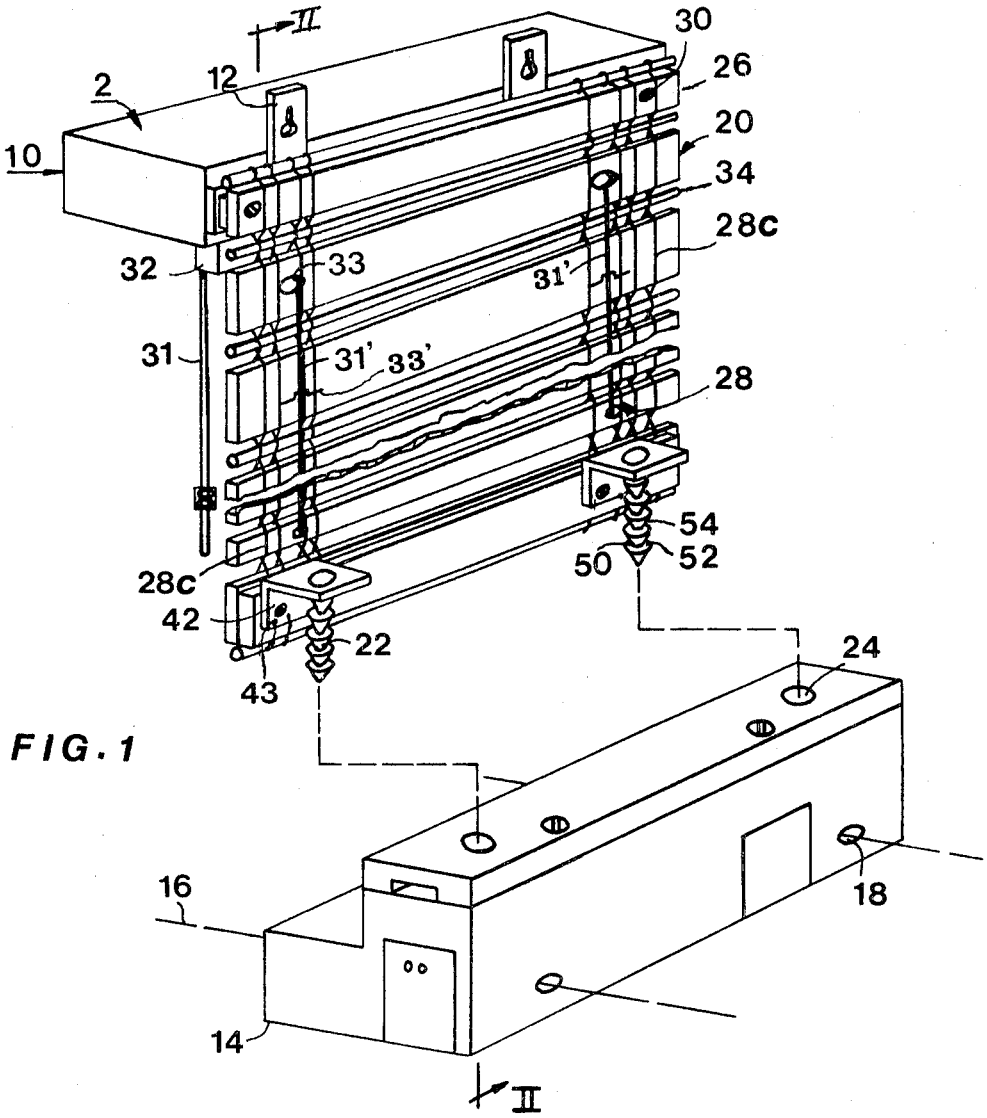
FIG. 1 is a three-dimensional view illustrating, from the rear, one form of combined window barrier and burglar alarm system constructed in accordance with the present invention.
Figure 4:
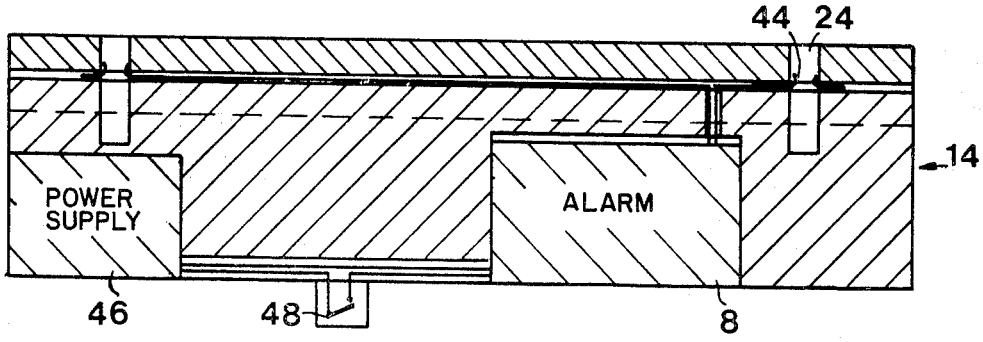
FIG. 4 is an enlarged schematical view illustrating the lower frame member in the device of FIG. 1.
Figure 2:
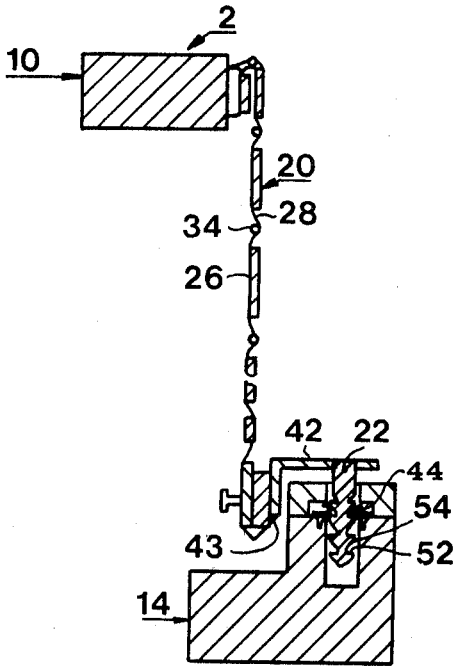
FIG. 2 is a sectional view along lines II—II of FIG. 1.

More particularly, as shown in FIG. 1, the combined window barrier and burglar alarm system 2 comprises an upper frame member 10 secured by lugs 12 to the wall 4 at the upper end of window opening 6, and a lower frame member 14 secured to the wall at the lower end of the window opening by fasteners 16 passing through openings 18. The upper frame member 10 supports in suspension a barrier, generally designated 20, carrying pins 22 at its lower end adapted to be received within mating sockets 24 formed in the lower frame member 14.

The barrier 20 is in the form of a window blind, of the woven-wooden type, including a plurality of slats 26 supported in horizontal positions by a plurality of flexible cords 28 extending vertically at right angles to the slats. The topmost slat 26 is secured to the upper frame member 10 by fasteners 30, and the flexible cords 28 are looped around the topmost slat 26 and support the remainding slats in suspension from the upper frame member 10. Such constructions are well known in woven-wood blinds, wherein the vertically-extending flexible cords 28 support all the slats together in spaced parallel relationship and permit them to be raised and compacted together by pulling on a raising cord 31. The latter cord passes through a cord lock 32, wherein it is subdivided into two extensions 31' each would over a pulley (not shown) at the opposite ends of the cord lock 32. The extensions 31' extend vertically downwardly along the opposite sides of the slats, passing through openings 33 in some and attached by staples 33' to the rear faces of others. As in the known constructions, the cord lock 32 is actuated by the pull cord 31 to selectively lock the blind in its raised condition, or to release it whereupon the blind drops down by gravity.

The slats 26 may be made of wood, plastic or metal. Preferably, reinforcing reeds or rods 34 are interposed in the spaces between adjacent slats 26, the flexible cords 28 being interwoven around these reinforcing rods. A reinforcing rod 34 is also included above the topmost slat 26 and below the bottommost slat 26, the reinforcing cords being interwoven around the two latter rods.

According to the present invention, certain of the flexible vertically-extending cords 28 are provided with metal wires which strengthen the blind and also serve as electrical conductors which establish an electrically-conductive pathway through the length of the blind. In the illustrated example, one of such cords, indicated as **28*c*, at each of the two sides of the blind 20 is provided with the electrical conductors. This may easily be accomplished by making the flexible cords 28 of yarns (e.g., of natural or plastic fabric threads) and including fine electrical conductor wires in those yarns, identified at 28*c*, which are intended to be in the electrically-conductive pathway through the blind. The electrically-conductive yarns 28*c* should not be readily distinguishable from the non-conductive yarns 29 so as not to distract from the overall appearance of the blind and also not to make it readily apparent to an unauthorized person that the blind is armed with a burglar alarm system. This can be easily accomplished by covering the electrical conductors in yarn 28*c* with the fabric or plastic threads, or by coloring the electrically-conductive threads the same color as the non-conductive threads. Another alternative is to include the electrically-conductive threads in all the yarns 28, even though only the two yarns 28*c* at the opposite sides of the blind are connected in the electrically-conductive pathway, whereby the conductive threads will impart the same ornamental appearance too all the yarns 28**.

The rods 34 may be of wood or plastic for decorative purposes, but may also be of metal to serve as a strengthening grille.

Figure 3:
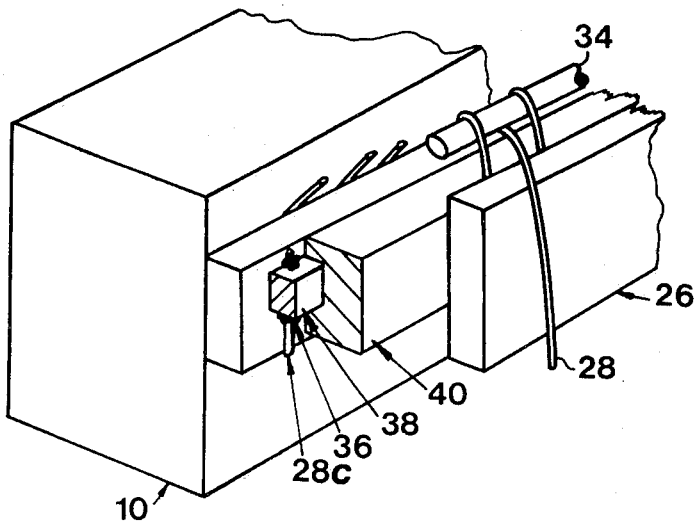
FIG. 3 is an enlarged fragmentary view of a portion of the upper frame member in the device of FIG. 1.

The yarns **28*c*, containing the electrically-conductive threads included in the conductive pathway of the burglar alarm system, are connected at their upper ends, as by welding as shown at 36 in FIG. 3, to an electrically-conductive bridge 38 in a rectangular housing 40 fixed to the upper frame member 10 and extending across the complete length of the frame member. Thus, bridge 38 electrically connects together the upper ends of the conductive threads 28*c*** at the opposite sides of the blind.

The pins 22 carried by the lower end of the blind 20 are of metal and are secured to the bottommost slat by metal lugs 42. The lower ends of the conductive threads **28*c* are connected, as by welding 43 (FIG. 1), to the lugs 42 which, being of metal, electrically connect them to the pins 22**.

When the pins 22 are received within the sockets 24 in the lower frame member 14, they engage electrically-conductive contact elements 44 which complete the electrical circuit from a power supply unit 46, such as a battery, in the lower frame member 14 to the alarm unit 8 also within the lower frame member. This electrical circuit further includes a disabling switch 48 disposed on the inside of the window, which switch may be manually opened by the authorized user in order to disable the circuit to the alarm unit 8.

Preferably, each of the pins 22 is formed with a plurality of annular grooves 50 (FIG. 1) spaced axially along the length of the pin, each groove defining a flat face 52 extending at right-angles to the axis of the pin, and a conical face 54 extending at an acute angle to the pin axis. The contact elements 44 within the lower frame member 14 are seatable within one of these grooves 50, depending on how far the pin is inserted into its repective socket 24. They releasably retain the respective pin within the socket and also establish good electrical contact with the pin.

The operation of the device illustrated in FIGS. 1–4 will be apparent particularly with reference to FIG. 5. Thus, when the device is to be used as a burglar alarm system, the blind 20 is pulled down (closed), and the pins 22 are inserted within sockets 24. The disabling switch 48 is then closed thereby establishing an electrical circuit from the power supply 46 to the alarm unit 8 via the two pins 22, the two conductive yarns **28*c* at the opposite sides of the blind 20, and the bridge 38 in the upper frame member 10 connecting together the upper ends of the two conductive yarns 28*c*. Now, if an unauthorized person attempts to raise the blind, this will interrupt the above-described electrical circuit, which will actuate the alarm 8. The same thing will happen if an attempt is made to sever the blind, since this will also cause an interruption in the above electrical circuit and therefore an actuation of the alarm 8**.

Whenever an authorized person wishes to raise the blind, he would open the manual switch 48 to disable the alarm circuit, thereby permitting him to raise the blind without actuating the alarm.

Figure 6:
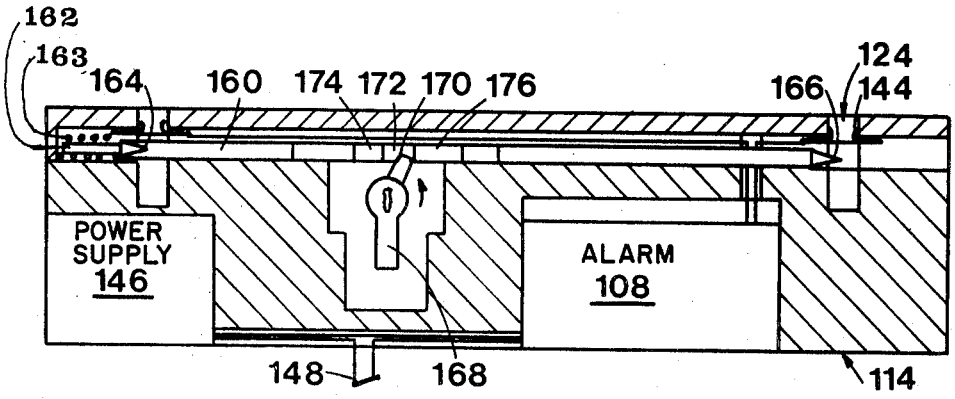
FIG. 6 illustrates a modification in the construction of the lower frame member to enable the device to be locked in its closed position and released for opening only by an authorized person having the proper key.
Figure 7:
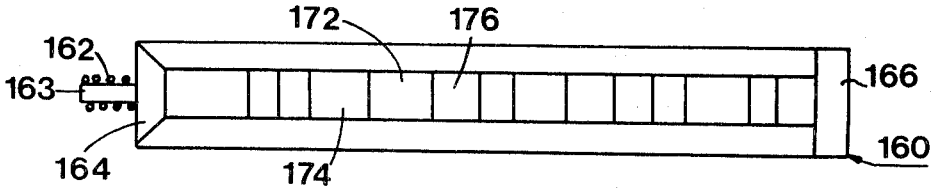
FIG. 7 is a top plan view of the mechanical locking element in the locking arrangement illustrated in FIG. 6.

FIGS. 6 and 7 illustrate a modification in the system, particularly in the construction of the lower frame member therein designated 114, permitting the blind to be mechanically locked in its closed position and to be opened only by a person having the proper key. For this purpose, the lower frame member 114 is provided with a locking device, generally designated 160 and more particularly illustrated in FIG. 7, which is adapted to engage the connector pins (22 in FIG. 1) for mechanically locking them in position within the sockets 124 of the lower frame member 114. These sockets also include the electrical contacts 144 for establishing electrical contact with these pins. In addition, the lower frame member 114 includes a spring 162 received on a pin 163 at one end of the frame member, which spring urges the locking member (rightwardly in FIGS. 6 and 7) into engagement with the pin connectors (22 in FIG. 1). More particularly, the locking member 160 is provided with tapered edges, as shown at 164 and 166 in FIGS. 6 and 7, which are seatable within the above-described annular grooves 50 (FIG. 1) of the connector pins 22, and engage the flat faces 52 of the grooves to lock the pins within the sockets 124. Thus, the blind would be mechanically locked in its lowermost position with the pins 22 establishing good electrical contact with the electrical contacts 144 within the lower frame member 114.

In order to mechanically release the blind to permit it to be raised, the lower frame member 114 is provided with a key-hole 168 which, upon the insertion of the proper key and its rotation (counter-clockwise in FIG. 6), moves a releasing member 170 movable within a slot 172 defined by two transverse lugs 174, 176 in the locking member 160. When releasing member 170 is moved by the key, it displaces the locking member 160 (leftwardly in FIGS. 6 and 7) against spring 162, so that the tapered edges 164, 166 of the locking member unseat from the annular grooves 50 (FIG. 1) in the connector pins 22, thereby permitting the blind to be raised.

In all other respects, the lower frame member 114 in FIGS. 6 and 7 is constructed in the same manner as described above, namely including the electrical contacts 144 establishing electrical continuity between the conductive yarns 28*c* in the blind with the power supply 146 and the alarm unit 108, and the manual switch 148 which enables the authorized user to disable the alarm circuit in order to raise the blind without activating the alarm unit 108.

Figure 8:
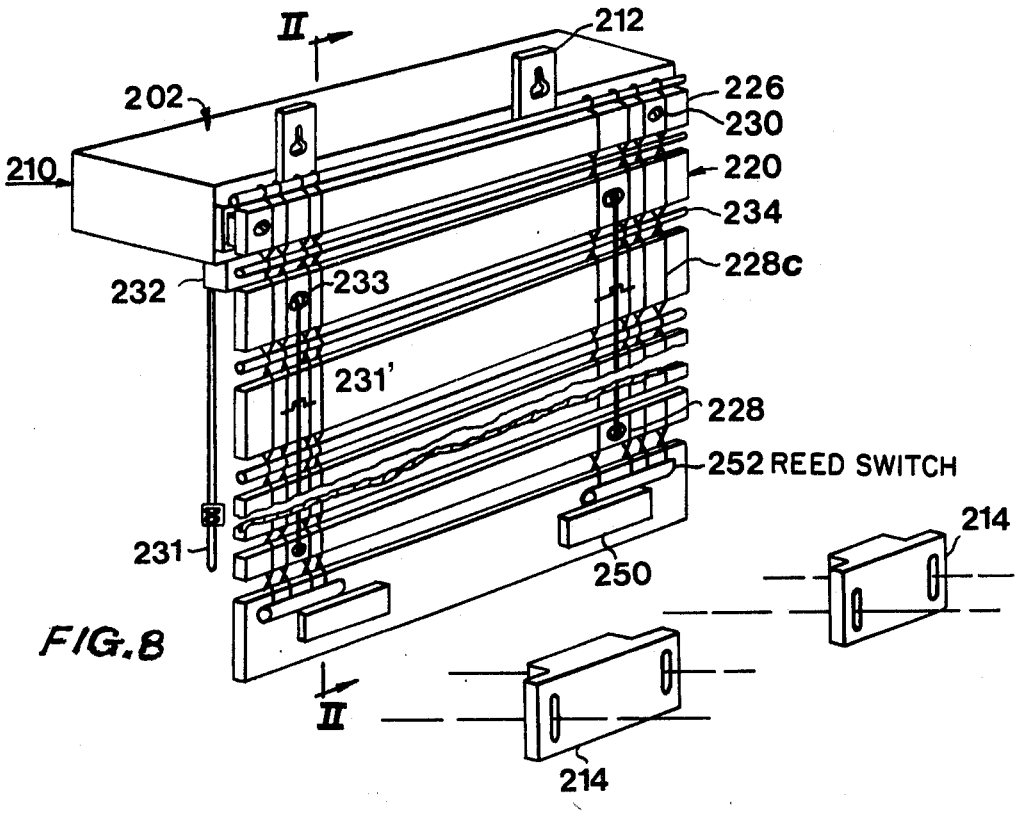
FIG. 8 is a view similar to that of FIG. 1 showing a second embodiment of the invention.
Figure 9:
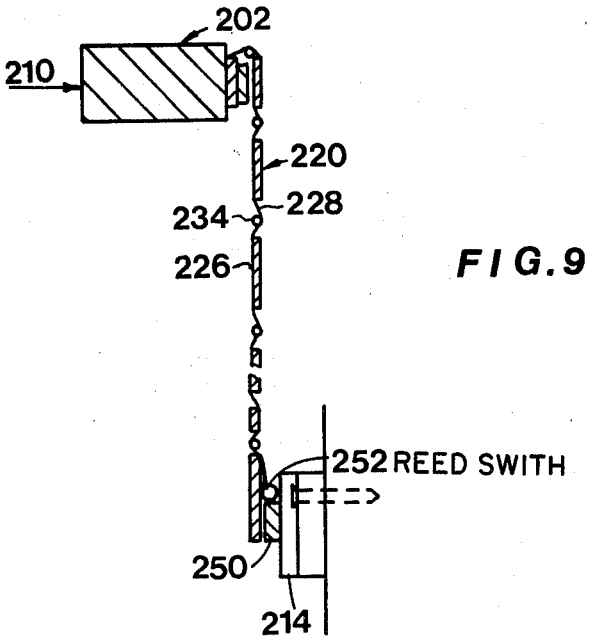
FIG. 9 is a view similar to that of FIG. 2 but illustrating the embodiment of the invention of FIG. 8.

FIGS. 8 and 9 illustrate another embodiment of the invention wherein the retaining means are in the form of magnetic elements carried by the window blind and the frame, and the circuit-interruption means is in the form of a reed switch carried at the lower end of the window blind and actuated by the magnetic element of the frame.

Thus, the window blind in FIG. 8 and 9 is generally designated 202 and is suspended from an upper frame 210 secured by lugs 212 to the wall at the upper end of the window opening. The lower frame member is in the form of or includes two magnetic elements 214 secured to the wall at the lower end of the window opening.

The window blind, generally designated 220, is preferably also of the woven-wooden type, including a plurality of slats 226 supported in horizontal positions by a plurality of flexible cords 228 extending vertically at right angles to the slats. The topmost slat 226 is secured to the upper frame 210 by fasteners 230, and the flexible cords 228 are looped around the topmost slat 226 and support the remaining slats in suspension from the upper frame 210. FIG. 8 further illustrates the pull-cord 231 for raising and compacting the slats, which cord passes through a cord lock 232 wherein it is subdivided into the two extensions 231', passing through openings 233 in some of the slats, the blind being reinforced by the reinforcing reed or rod 234 interposed in each space between adjacent slats. As in the above-described embodiment, the embodiment of FIGS. 8 and 9 also includes the metal wires, e.g. 228*c*, which strengthen the blind and also serve as the electrical conductor to establish an electrically-conductive pathway through the length of the blind.

The lower end of the blind includes two magnetic elements 250 adapted to cooperate with the magnetic elements 214 secured to the wall below the window opening. Thus, when the blind is in its closed position, as illustrated in FIG. 9, it is retained in this position by magnetic elements 250 of the blind being attracted to magnetic elements 214 attached to the wall.

In addition, the electrical conductors 228*c* which established the electrically-conductive pathway through the length of the blind are connected in the circuit by a magnetic reed switch 252 which, as known, is actuated by a magnetic field. The arrangement is such that when the blind is in its lowermost position, as illustrated in FIG. 9, magnetic element 214 attached to the wall actuates the reed switch 252 so as to close its contacts, and thereby complete the electrically-conductive pathway through the blind; but if the blind is raised or otherwise moved so as to move the lower end of the blind, and thereby the reed switch 252, away from the respective magnetic element 214 fixed to the wall, the reed switch will open to interrupt the electrical circuit including the conductors 228*c*.

In the arrangement illustrated in FIGS. 8 and 9, the electric circuit, including the alarm and the disabling switch (not shown), would be housed within the upper frame 210.

While the invention has been described with respect to woven-blinds for windows, it will be appreciated that it could take other forms, for example Venetian blinds or roll-up blinds, and that they could be used for protecting other openings in building structures, such as doors or internal passageways. Many other variations and applications of the invention will be apparent.

What is claimed is:

1. A protective barrier for mounting to a structure to cover an opening therein, comprising: a plurality of slats mounted to said structure at one end of said opening and extending in spaced parallel relationship towards the opposite end of said opening; two groups each including a plurality of flexible cords extending at right angles to said slats along opposite sides thereof, said flexible cords being interwoven between said slats for securing them in said spaced parallel relationship but permitting them to be pivotted to open the slats and to be moved towards one end of the opening to open the barrier; at least some of said flexible cords including metal wires serving to securely hold the slats together and also to serve as electrical conductors; each of said groups of flexible cords being of yarn only some of which include said metal wires in a manner so as not to be readily distinguishable from those yarns which do not include metal wires; circuit means including said metal wires establishing an electrically-conductive pathway through the length of said barrier; means for supplying electrical power to said electrically-conductive pathway; an end member secured to the structure along said opposite end of the opening therein; mating retaining means carried by said end member and one end of the barrier mechanically retaining the barrier in its closed position covering said opening; circuit interrupting means effective, when the barrier is retained in its closed position, to establish electrical continuity in said electrically-conductive pathway through the length of said barrier, and when moved from its closed position to interrupt said electrical continuity; a signalling device actuated by an interruption in said pathway caused by the severance of said metal wires in the barrier or by the actuation of said circuit interrupting means.

2. A barrier according to claim 1, wherein said mating retaining means and circuit interrupting means includes electrically-conductive pins carried at the end of the barrier receivable in correspondingly-located sockets in the end member, said end member further including mechanical locking means for locking the electrically-conductive pins within their sockets and key-operated means for releasing them in order to permit opening the barrier.

3. A barrier according to claim 2, wherein said mechanical locking means comprises a locking plate carried by said end member and having surfaces adapted to engage the electrically-conductive pins when the locking plate is in locking position, and a spring urging said locking plate into locking position with respect to said pins, said key-operated means including a releasing member movable by the key for moving said plate into unlocking position in order to release said pins.

4. A barrier according to claim 3, wherein said pins are formed with one or more annular grooves along their lengths, which grooves are engageble by spring-biased clips contained in the sockets of said end member.

5. A barrier according to claim 1, wherein said retaining means comprises magnetic elements carried by said barrier and said end member.

6. A barrier according to claim 5, wherein said circuit interrupting means comprises a magnetic reed switch carried by said barrier and actuated by the magnetic element carried by said end member to establish said electrical contact when the barrier is retained in its closed position, and to interrupt said electrically-conductive pathway when the barrier is in its open position.

* * * * *